United States Patent [19]

Ruotsalainen

[11] 4,224,853

[45] Sep. 30, 1980

[54] DIAPOSITIVE TRIMMER

[76] Inventor: Matti K. Ruotsalainen, Neitsytsaarentie 8 E 25, 00960 Helsinki 96, Finland

[21] Appl. No.: 891,281

[22] Filed: Mar. 29, 1978

[30] Foreign Application Priority Data

Apr. 5, 1977 [FI] Finland ..... 771070

[51] Int. Cl.[3] ..... B26D 7/16

[52] U.S. Cl. ..... 83/412; 83/423; 83/452; 83/520; 83/522; 83/564; 83/599; 83/605; 83/682

[58] Field of Search ..... 83/412, 423, 452, 520, 83/522, 564, 599, 605, 682

[56] References Cited

U.S. PATENT DOCUMENTS

| | | | |
|---|---|---|---|
| 2,588,087 | 3/1952 | Connor et al. | 83/520 X |
| 2,591,519 | 4/1952 | Decker | 83/520 X |
| 3,585,890 | 6/1971 | Brenaman, Sr. et al. | 83/520 X |
| 3,744,902 | 7/1973 | Henker | 83/412 X |
| 4,143,571 | 3/1979 | Oxenham | 83/412 |

*Primary Examiner*—Frank T. Yost
*Attorney, Agent, or Firm*—Darby & Darby

[57] ABSTRACT

A device for trimming a diapositive with trimming angles and punching pins so the diapositive can be exactly positioned within a frame.

3 Claims, 4 Drawing Figures

DIAPOSITIVE TRIMMER

The present invention relates to a trimming device for diapositives whereby unessential parts of the picture are trimmed away from diapositives by means of trimming angles movable in vertical and horizontal direction of the horizontal plane, whereafter the diapositive and trimming angles are simultaneously cut by the press member of the trimmer so as to be of suitable size for the diapositive frame, and in the margins thereof are pressed direction holes corresponding to the direction pegs of the diapositive frame.

Manual trimming of diapositives requires great accuracy and time and the rectilinearity of the trimming is not guaranteed even then. The uncertainty of the trimming is further added to by glues of the trimming tapes, e.g. a tape with wet glue must hit the right sport at the first attempt, if this is not the case the diapositive must be washed and dried before a new attempt. Some of the glues of the glue tapes used for the trimming spread in a period of years over the diapositives spoiling them. One of the inconveniences in the framing, on the other hand, is cutting the diapositive so as to make it fit the frame and centering of the trimmed area in the middle of the diapositive frame opening.

The object of the present invention is to eliminate said drawbacks by means of a new trimming and framing method of diapositives, whereby the diapositive can be quickly, rectilinearly and accurately trimmed without glues, which is manually impossible and, thanks to the direction holes, the diapositive and trimming angles in the frame can be at once properly placed, the trimmed area in the middle of the diapositive frame opening.

The utilization of the invention requires a diapositive frame having direction pegs in the spots corresponding to the locations of the direction holes of the diapositives and trimming angles, into which pegs the diapositive and trimming angles are set.

List of the figures of the drawings relating to one embodiment of the invention.

The device according to the invention comprises the following parts:

1 mat glass, 2 direction marks, 3 bulb, 4 suction holes, 5 trimming angle transfer element, 6 trimming angle holder arm, 7 trimming angle holder, 8 trimming angle, 9 trimming angle adjustment knob, 10 threaded shaft, 11 counter-clockwise thread, 12 clockwise thread, 13 grooved gear shaft, 14 dovetail groove, 15 rack bar, 16 gear sheel, 17 support axle for trimming angle transfer element, 18 attachment and bearing element for axles, 19 lock screws for axles, 20 fastening element for the lower portion of the press, 21 frame plate, 22 box, 23 transfer opening for trimming angle holder, 24 slide bar for press portion, 25 support bar for press portion, 26 lateral movement stopper for press portion, 27 passage hole for press portion support bar, 28 reset spring for press portion, 29 press portion vertical movement stopper and fastening member for lever arm, 30 bearing for press portion vertical movement stopper and for lever arm fastening member, 31 socket pin for the lever arm of the press, 32 lever arm of the press, 33 support element for the lever arm of the press, 34 bearing for the lever arm of the press, 35 bearing axle for press lever arm, 36 press body element, 37 cutting frame, 38 guide frame for punching pins, 39 punching pin, 40 punch hole, 41 reset spring for punsh frame, 42 guide screw for punch frame reset spring, 43 steering element for the guide screw of punch frame reset spring, 44 cut diapositive, 45 direction hole, 46 cut trimming angles, 47 lower part of the diapositive frame, 48 diapositive frame opening, 49 direction pegs and 50 diapositive frame upper part.

Figure 1:
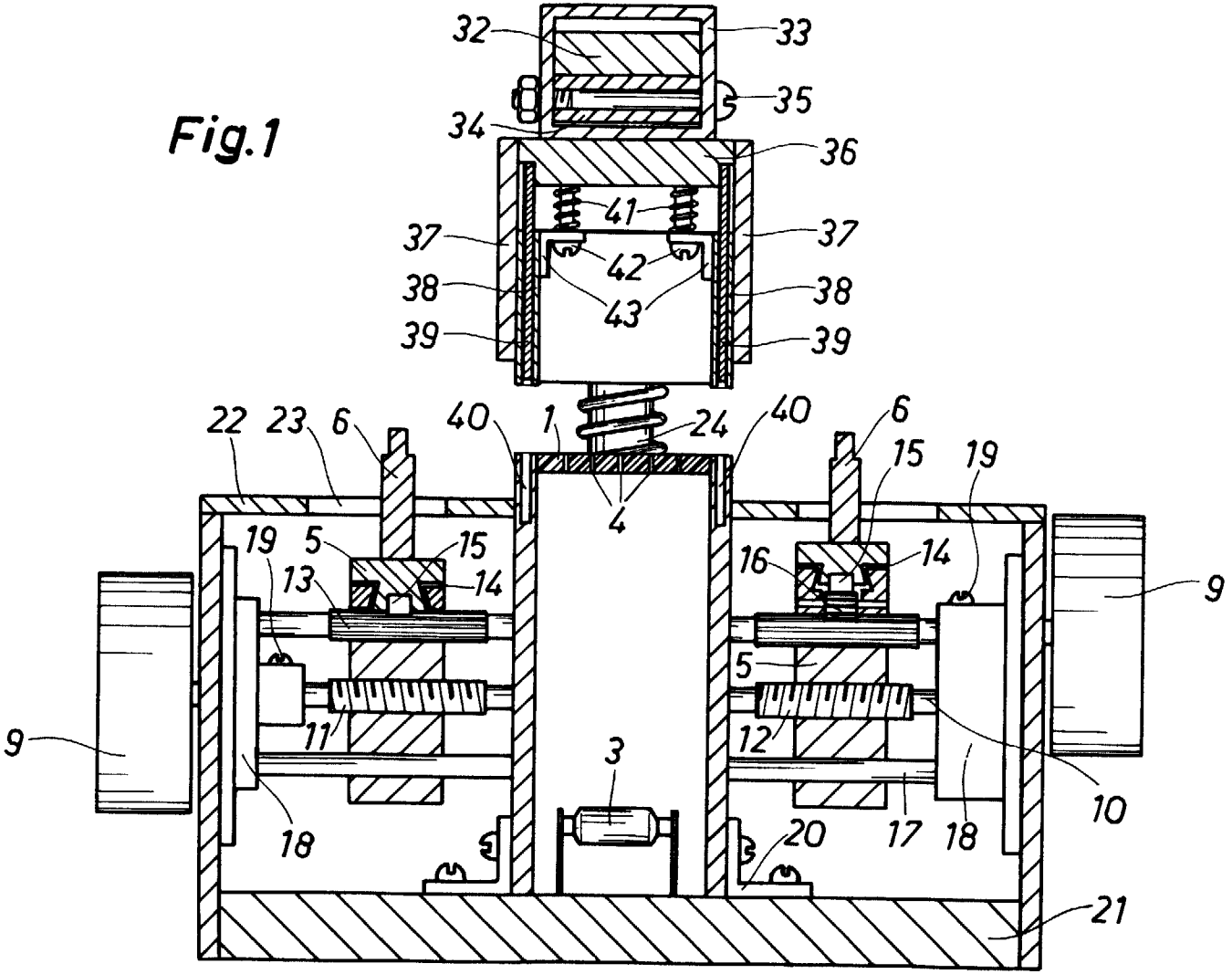
FIG. 1 is a sectional front view of the device.
Figure 2:
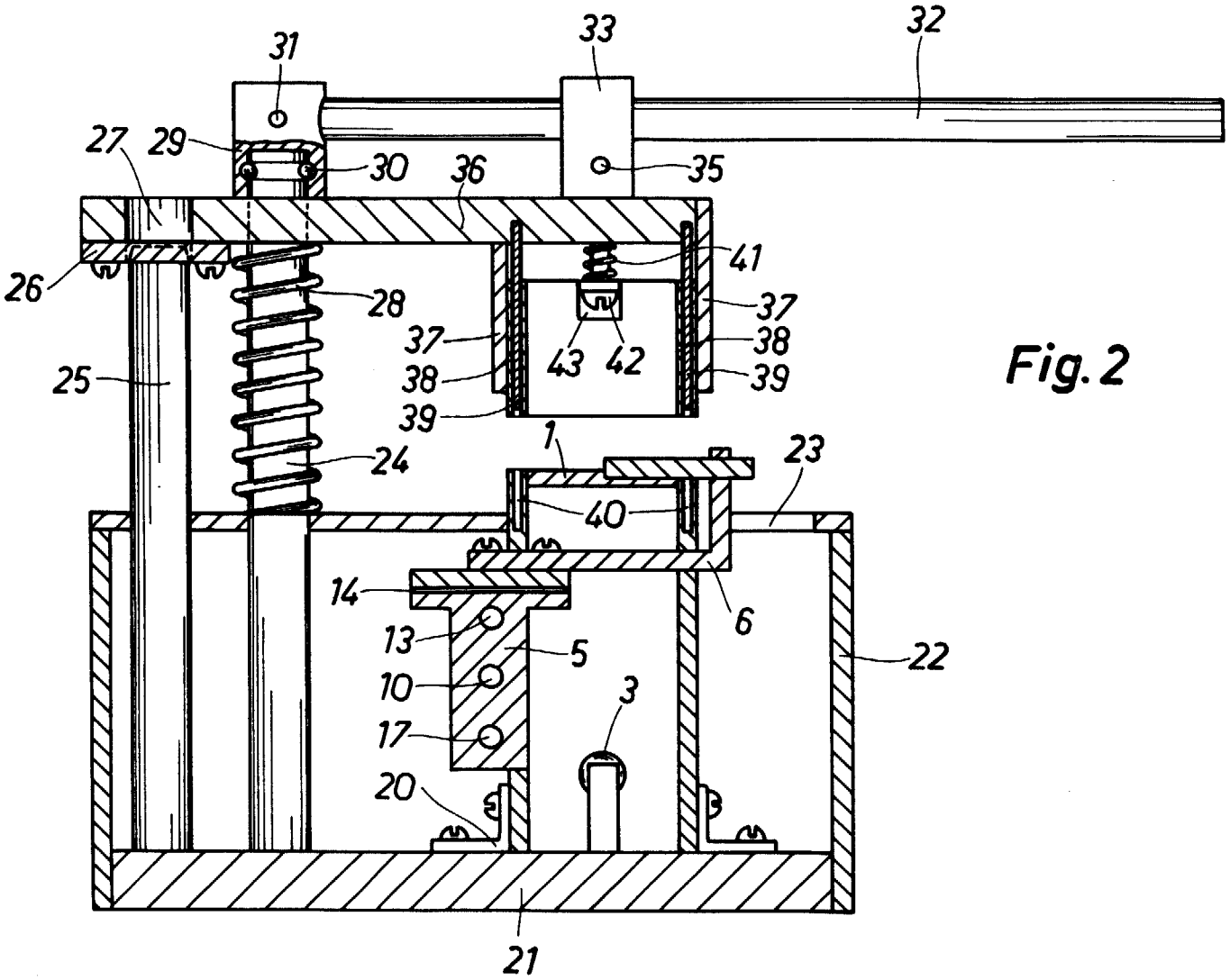
FIG. 2 is a sectional side view.
Figure 3:
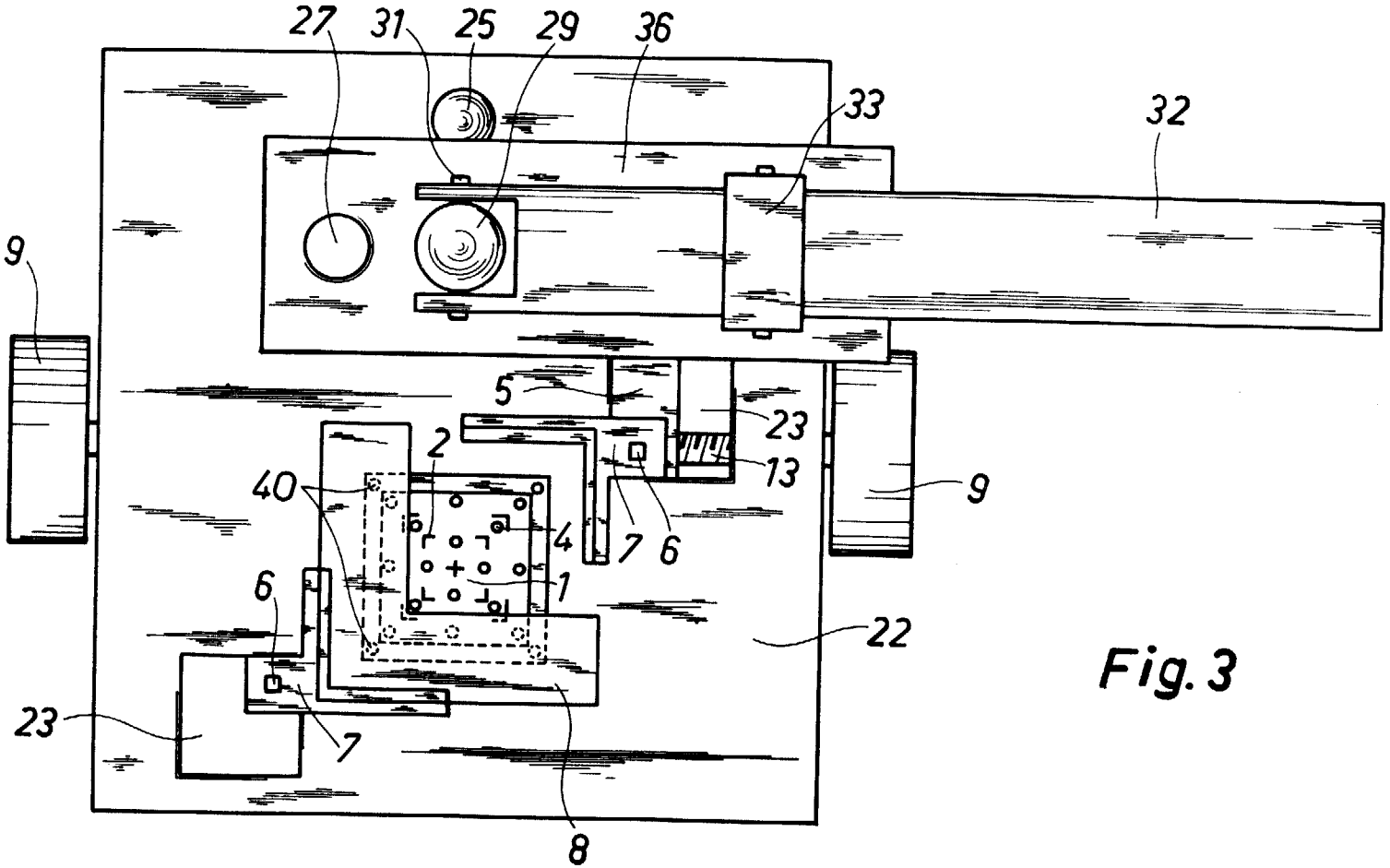
FIG. 3 shows the device from above.

In the apparatus shown in FIGS. 1, 2 and 3, the diapositive to be trimmed is laid on a mat glass 1 illuminated from below and provided with direction marks 2. The diapositive is positioned by means of the direction marks 2 in such a way that the area to be trimmed lies in the middle of the mat glass 1 on which the diapositive is held by suction obtained by a suction pump (not shown) under the mat glass 1 and suction hols 4 in the glass 1. Trimming angles 8 are placed into their holders 7, the left-hand trimming angle adjustment knob 9 is turned, whereby the shaft 10 provided with counter-clockwise 11 and clockwise 12 threads, on rotation thereof, brings the trimming angles 8 from opposite sides onto the diapositive covering those areas of the diapositive to be trimmed away in the vertical direction. By turning the right-hand adjustment knob 9, the grooved gear shaft 13 moves the trimming angles 8 of the transfer elements 5 provided with a dovetail groove 14 and a rack bar 15 in the vertical direction of horizontal plane onto the diapositive covering those areas of the diapositive to be trimmed away in the horizontal direction. The press portion is turned onto the diapositive and, on depression of the lever arm 32, the punching pin guide frame 38, which lies inside the cutting frame 37, presses the diapositive and trimming angles against the lower portion of the press, the punching pins 39 extending through the guide frame perforate the corners of the diapositive and those of the trimming angles to form direction holes 45, whereafter the cutting frame 37 cuts the diapositive and trimming angles so as to fit the frame. In order to move the trimming angles also in vertical direction simultaneously onto the diapositive, one of the transfer elements 5 of the trimming angles is provided with a gear wheel 16.

The invention according to the above example is intended for trimming all diapositive sizes since the size and shape of the diapositive are taken into consideration when the device is manufactured. The direction holes are intended to be placed in the most suitable spots with respect to the shape of each diapositive type, e.g. 35 mm film size the direction holes are on the long sides.

As an alternative to the above example, the trimming angles can also be manufactured in such a way that the trimming angle holder 7 and the trimming angle 8 are integral and the diapositive is held on the mat glass during the trimming operation by means of a weight to be placed in the middle or by magnet instead of suction. It is to be understood that the invention is not limited to the above example but it can be modified within the scope of the accompanying claims.

Figure 4:
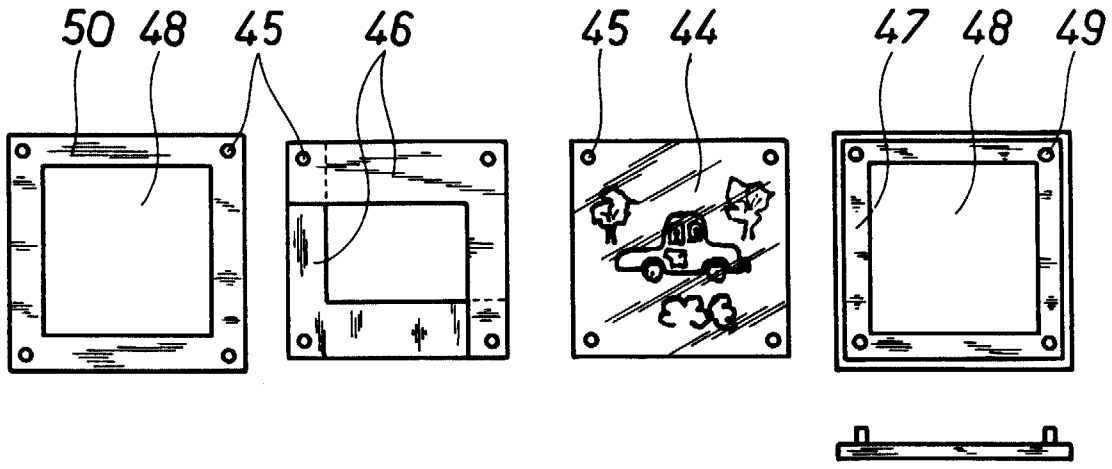
FIG. 4 shows the framing.

In the framing operation according to FIG. 4, the cut diapositive 44 and the cut trimming angles 46 as well as the diapositive frame upper part 50 are positioned by their direction holes into the pegs 49 of the diapositive frame lower part 47, and the frame is thereafter pressed shut.

I claim:

1. An apparatus for trimming a diapositive comprising:

(a) a perforated plate for positioning the diapositive;

(b) at least one trimming angle for forming a trimming area over the diapositive on the positioning plate; and (c) a cutter which comprises:

(1) a frame for cutting the angle and diapositive at a predetermined width; and (2) at least one punching pin for perforating both the angle and the diapositive, the positioning plate provided with a corresponding number of holes to allow for complete perforation of the angle and the diapositive.

2. The apparatus of claim 1 comprising two trimming angles.

3. The apparatus of claim 2 comprising four punching pins.

* * * * *